US005584779A

United States Patent [19]

Knecht et al.

[11] Patent Number: 5,584,779

[45] Date of Patent: Dec. 17, 1996

[54] STEP EXERCISING SYSTEM AND METHOD

[75] Inventors: Wendy S. Knecht, 630 San Vincente Blvd., Santa Monica, Calif. 90402; Kenneth A. Tarlow, Corte Madera, Calif.

[73] Assignee: Wendy S. Knecht, Santa Monica, Calif.

[21] Appl. No.: 420,191

[22] Filed: Apr. 10, 1995

[51] Int. Cl.[6] ..... A63B 21/00

[52] U.S. Cl. ..... 482/8; 434/250; 482/84

[58] Field of Search ..... 482/1–8, 83, 84; 434/250

[56] References Cited

U.S. PATENT DOCUMENTS

| | | | |
|---|---|---|---|
| 2,402,109 | 6/1946 | Williams . | |
| 2,605,557 | 8/1952 | Deventer | 434/250 |
| 3,933,354 | 1/1976 | Goldfarb et al. . | |
| 5,009,419 | 4/1991 | Streeter . | |

FOREIGN PATENT DOCUMENTS

| | | | |
|---|---|---|---|
| 2544109 | 10/1984 | France | 434/250 |

*Primary Examiner*—Richard J. Apley
*Assistant Examiner*—Glenn E. Richman
*Attorney, Agent, or Firm*—Fish & Richardson P.C.

[57] ABSTRACT

A step exercising system for choreographing an aerobic step workout comprising: step support structure including a plurality of spaced-apart step surfaces supported above a ground surface by respective step heights that are selected to enable a user to step from the ground surface onto the step surfaces during a step workout; a cuing device for indicating to the user which step surfaces to step on; and a controller coupled to the cuing device and constructed and arranged to activate the cuing device to indicate to the user an ordered sequence of step surfaces to step on, thereby choreographing an aerobic step workout for the user. Step exercising methods based upon the above-mentioned step exercising system are also disclosed.

23 Claims, 14 Drawing Sheets

STEP EXERCISING SYSTEM AND METHOD

BACKGROUND OF THE INVENTION

This invention relates to step exercise.

Platforms used for step aerobic exercise are known to provide a healthy form of cardiovascular stimulation. Currently, step aerobic classes are offered to groups of people at most fitness centers. Audio and video tapes are also available for conducting step aerobics independently at home. Other known forms of indoor aerobics exercise include, e.g., stationary exercycles, stair machines, treadmills, and rowing machines. Many of these stationary machines include microprocessor-controlled programs that allow a user to select different workout routines at specified skill levels.

SUMMARY OF THE INVENTION

In one aspect, the invention features a step exercising system for choreographing an aerobic step workout comprising: step support structure including a plurality of spaced-apart step surfaces supported above a ground surface by respective step heights that are selected to enable a user to step from the ground surface onto the step surfaces during a step workout; a cuing device for indicating to the user which step surfaces to step on; and a controller that is coupled to the cuing device and is constructed and arranged to activate the cuing device to indicate to the user an ordered sequence of step surfaces to step on, thereby choreographing an aerobic step workout for the user.

Embodiments may include one or more the following additional features. The cuing device preferably comprises a plurality of separate cuing devices respectively associated with the spaced-apart step surfaces. A plurality of sensors (e.g., pressure sensors) are preferably included, positioned respectively at the step surfaces for detecting when the user steps onto the step surfaces. The sensors are preferably coupled to the controller. The controller is preferably adapted to communicate to the user that the user successfully stepped onto a cued step surface. The controller is also preferably adapted to communicate to a user that the step sequence followed by the user did not correspond to the step sequence cued by the controller. A monitor is preferably provided for displaying parameters indicative of the user's workout performance (e.g., a running total of missteps, average step rate, and an estimated number of calories burned during a workout). The spaced-apart step surfaces are preferably movable with respect to each other to enable selective variation of the distances separating the step surfaces. The movable step surfaces are preferably electrically coupled to the controller by coiled wire running between the step surfaces, wherein the spacing between coils in the coiled wire between two step surfaces spread apart when the surfaces are moved apart. The step surfaces are preferably arranged in an arcuate pattern. The cuing devices preferably emit light to cue the user. Each cuing device associated with a step surface preferably emits light of a different color from that emitted by any other cuing device. In some embodiments, the controller has memory for storing a plurality of preselected step sequences. A user interface is preferably provided for receiving commands from the user specifying one or more of the preselected step sequences. A further user interface is preferably provided for receiving commands from the user for selecting an intensity level for the workout to be choreographed by the controller. Also preferably provided are one or more risers adapted to couple to the step support structure to selectively increase the height of one or more of the step surfaces above the ground surface. The step exercising system preferably has three to five step surfaces. In one embodiment, first and second step support structures are coupled to a single controller that is adapted to choreograph separate aerobic step workouts for first and second users onto the first and second step support structures, respectively.

In another aspect, the invention features a method for choreographing an aerobic step workout comprising the steps of: (a) providing step support structure having a plurality of spaced-apart step surfaces supported above a ground surface by respective step heights that are selected to enable a user to step from the ground surface onto the step surfaces during a step workout; (b) cuing the user with a plurality of cuing devices respectively associated with the spaced-apart step surfaces to indicate which step surfaces to step on; and (c) choreographing an aerobic step workout for the user by cuing with the cuing devices an ordered sequence of step surfaces for the user to step on.

In another aspect, the invention features a method for choreographing a user's aerobic step workout comprising the steps of: (a) providing step support structure having a plurality of spaced-apart step surfaces supported above a ground surface by respective step heights that are selected to enable a user to step from the ground surface onto the step surfaces during a step workout; (b) cuing the user to step onto one of the step surfaces; (c) cuing the user to sequentially step onto the one or more steps previously stepped upon, in the order in which the steps were cued to the user; (d) determining if the step sequence followed by the user corresponds to the cued step sequence; and (e) repeating steps (b), (c) and (d) until a preselected workout is complete or until the step sequence followed by the user does not correspond to the cued step sequence.

In some embodiments, the controller is adapted to choreograph a random step sequence.

The following are examples of the advantages offered by the step exercise system and method of the invention.

Many people are intimidated by traditional step classes because the classes are fast-paced and require a high fitness level, making it confusing and frustrating to learn the steps if one does not attend class on a regular basis. In contrast, the exercise format provided by the invention makes it very easy to grasp step moves; and the step exercising cues used according to the present invention are easy for a novice stepper to follow. This makes step activity accessible to less experienced exercisers, and also to less coordinated people, while still providing a challenging step workout. The invention can also be easily used as a fun exercise game for children. The inventive step exercising system of the invention not only serves as an instructional device, but also allows for new step sequence patterns to be created, e.g., based on color combinations. Traditional step patterns may also be used, e.g. in combination with newly created patterns, with the instruction, i.e. cues, for step activity being given in terms of color. As a result, use of the invention can revitalize interest in step aerobics. The invention also provides an attractive combination of aerobic conditioning and coordination training. The exercising system of the invention allows a user to vary the workout intensity in different ways that can be independently optimized for a person's particular physical attributes and fitness level. Since the exercising system of the invention is designed for use by a single person, the user can pace himself or herself through a workout without worrying about falling behind other users. Furthermore, individuals who are intimidated by conventional step class can use the invention without feeling self-conscious.

In addition, the step exercising system of the invention can be used as well in a traditional step aerobics class setting. The display of parameters indicative of a user's workout performance enables tracking of his or her performance over time, and better management of his or her long-term, e.g., weekly or monthly, workout schedule.

Other features and advantages of the invention will become apparent from the following description of a presently preferred embodiment, and from the claims.

DESCRIPTION OF PRESENTLY PREFERRED EMBODIMENTS

Figure 1:
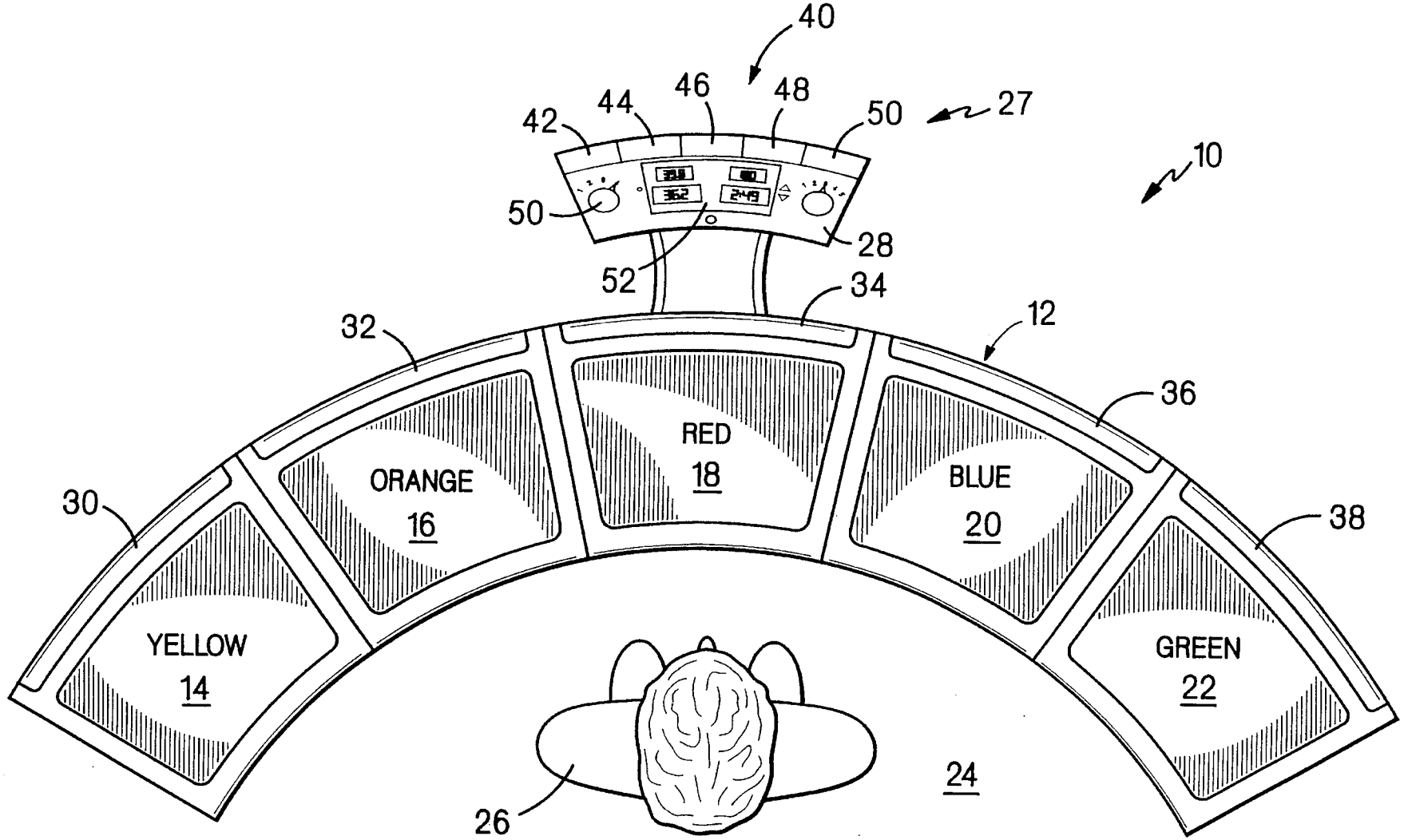
FIG. 1 is a diagrammatic top view of a step exercising system in during a controller-choreographed aerobic step workout.

Referring to FIG. 1, a step exercising system 10 of the invention includes step support structure 12 with a plurality of spaced-apart step surfaces 14–22, e.g. five are shown, supported above a ground surface 24 by respective step heights selected to enable a user 26 to step from the ground surface onto the step surfaces during an aerobic step workout. Step surfaces 14–22 are each of a different color (e.g., yellow, orange, red, blue, green, respectively, as shown in FIG. 1). A console 27 includes a controller 28 coupled to a similar plurality of separate cuing devices 30–38 (again, by way of example, five are shown) in the form of light bars that are respectively associated with a separate step surface. Each cuing device emits a colored light corresponding to the color of its associated step surface. A second cuing system 40, mounted upon a peripheral edge of the console, includes an array of lights 42–50 that emit colored light corresponding to the colors of step surfaces 14–22, respectively. The console lights and corresponding step surface lights are activated simultaneously to allow a user to watch the console lights or the lights associated with the step surfaces during an aerobic step workout. The controller includes a user interface 50 allowing the user to select between prestored aerobic workouts and customized user-defined workouts. A monitor 52 displays various parameters indicative of the user's performance during a workout (e.g., workout time, average step rate, estimated number of calories burned, total number of steps and number of missteps). The monitor can also display operating instructions, e.g., for first time users.

Figure 2:
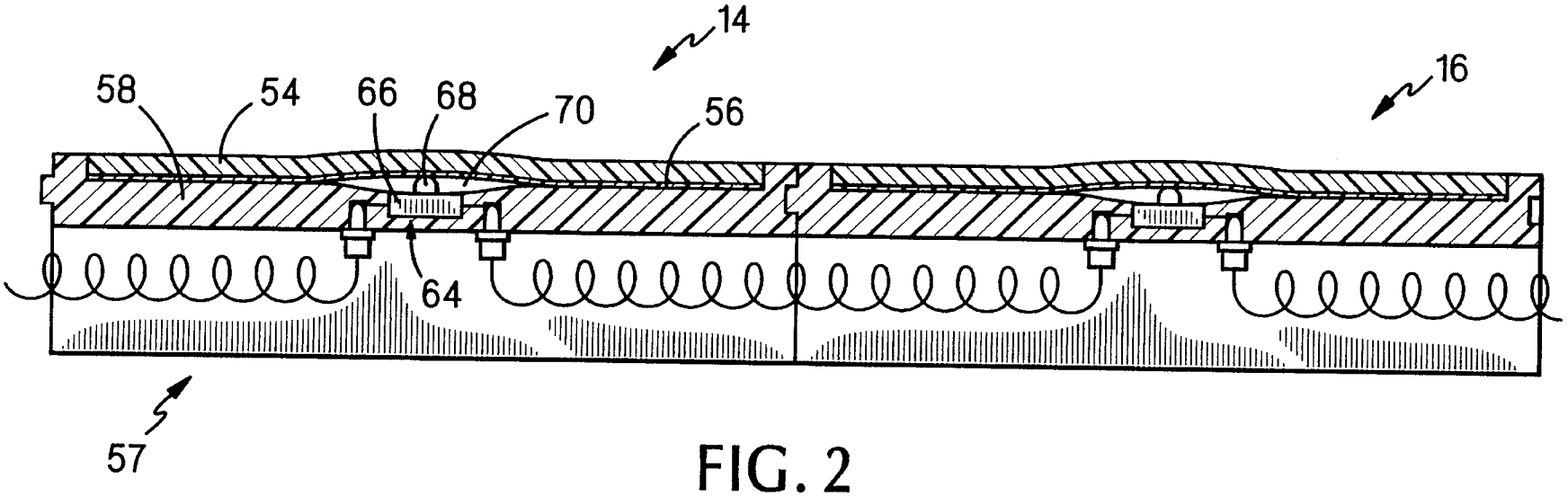
FIG. 2 is a diagrammatic cross-sectional side view of step support structure, bearing a plurality of step surfaces, of a portion of the step exercising system of FIG. 1.
Figure 2A:
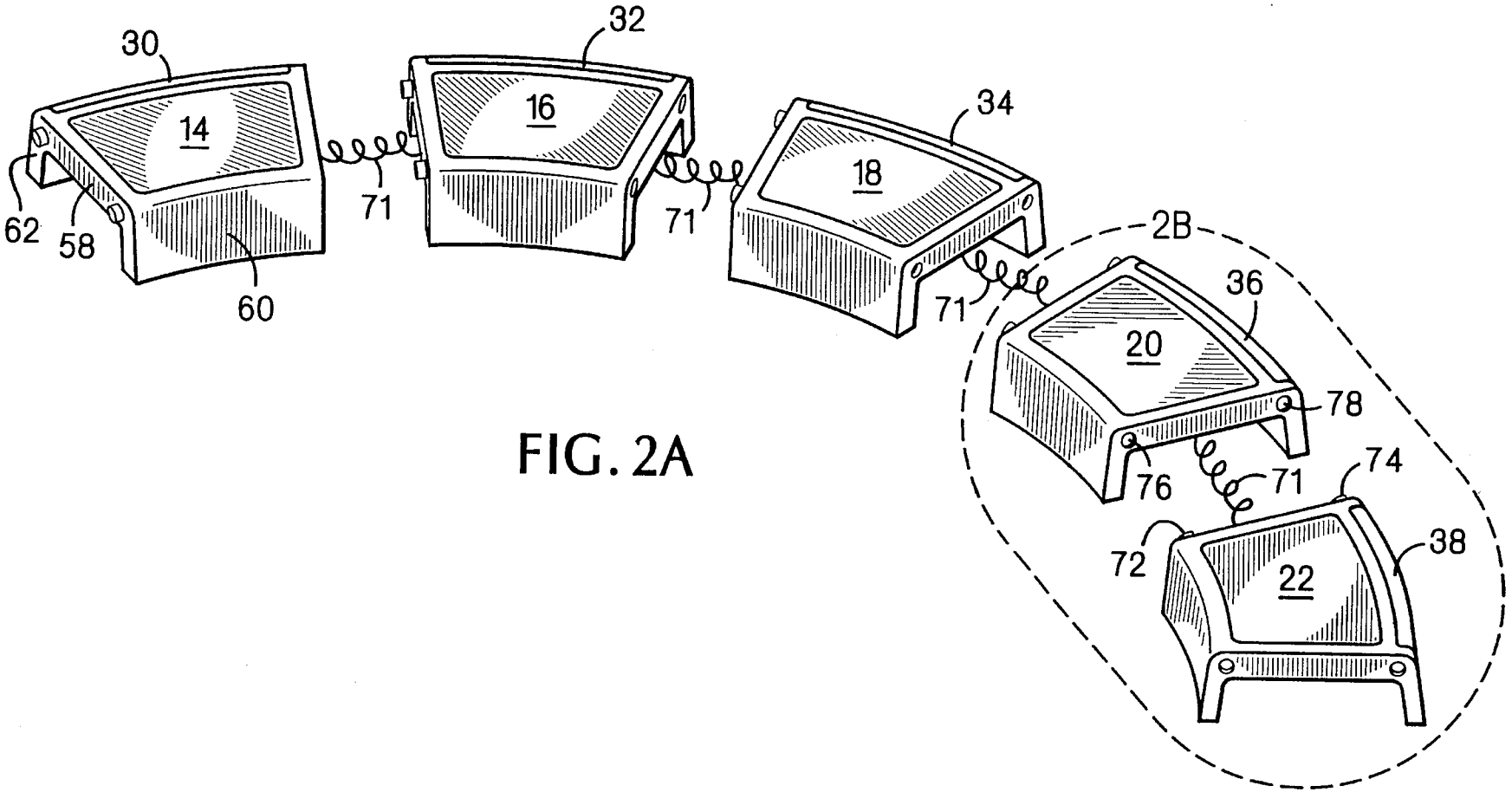
FIG. 2A is a diagrammatic perspective view of step support structure of a portion of the step exercising system of FIG. 1, with the step surfaces are spaced apart.
Figure 2B:
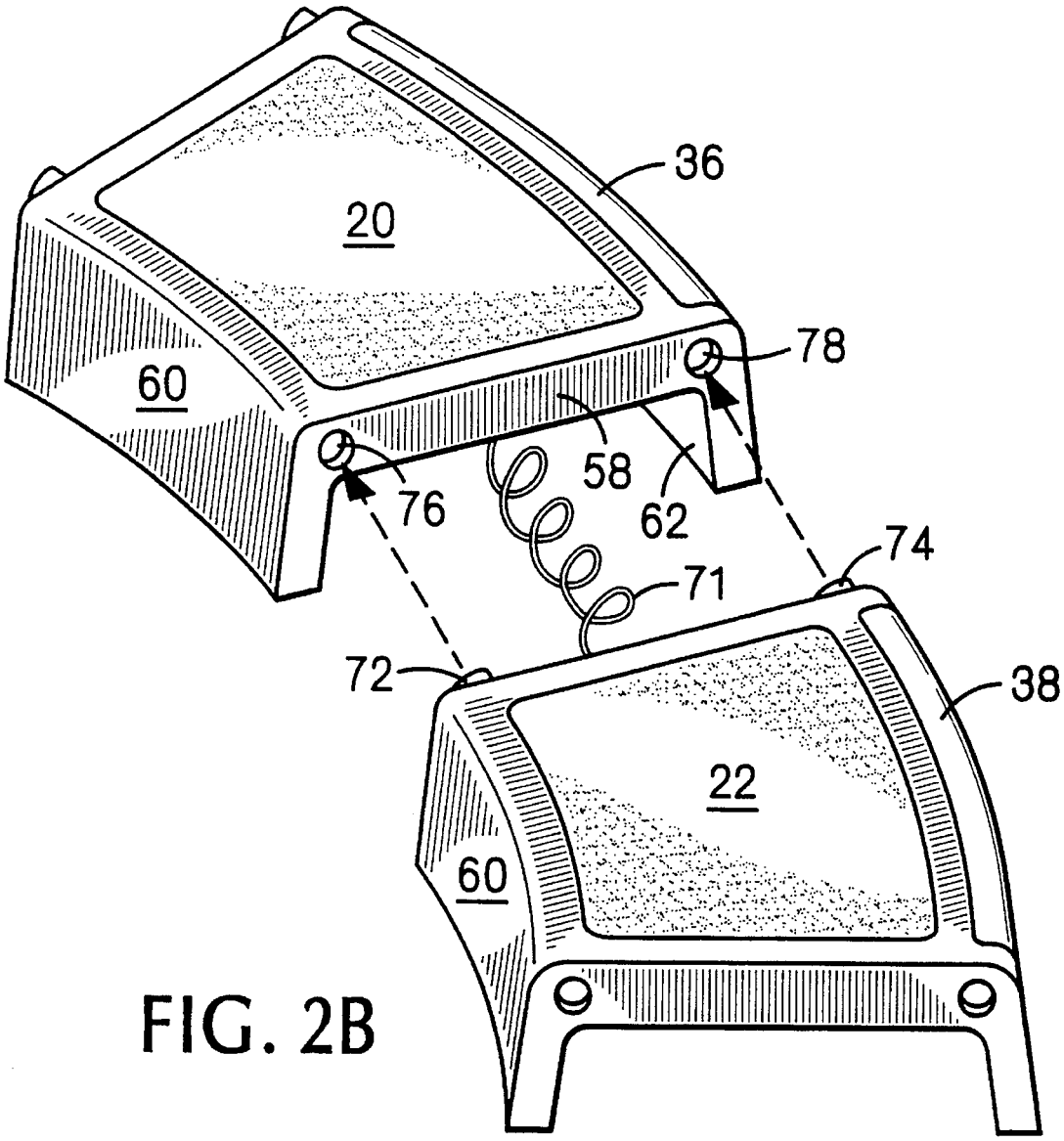
FIG. 2B is an enlarged diagrammatic view of a portion of the step support structure of FIG. 2A.

Referring to FIGS. 2–2B, each step surface is formed from a resilient step pad 54 bonded to a plastic plate 56 and fixedly attached to a step platform 57, with a tread 58 supported on opposite sides by side walls 60, 62. A pressure sensor 64, having a switch base 66 and a switch plunger 68, is mounted in a centrally located depression 70 in tread 58, with plunger 68 in contact with plate 56. The pressure sensors and cuing devices 30–38 are electrically connected in series to controller 28. When a user steps onto a resilient pad, the pad and the underlying plate yield to the user's weight, activating the pressure sensor by forcing plunger 68 downwards. Activation of the switch is electrically communicated to the controller, which uses this information to choreograph the aerobic step workout, as described more fully below.

As shown in FIGS. 2A and 2B, the step surfaces are separable from each other to increase workout difficulty, e.g., by requiring the user to cover more distance, or to accommodate users with longer legs. Wires 71 in the series connections between the step surfaces are coiled (e.g., similar to a telephone cord) to allow the step surfaces to be separated and to take up slack in the wires when the step surfaces are close together. Adjacent step platforms include plugs 72, 74 and mating receptacles 76, 78, respectively. The plugs and receptacles have hook and loop fasteners so that adjacent step platforms may be fixedly coupled together, increasing the stability of the step exercising system.

Figure 3:
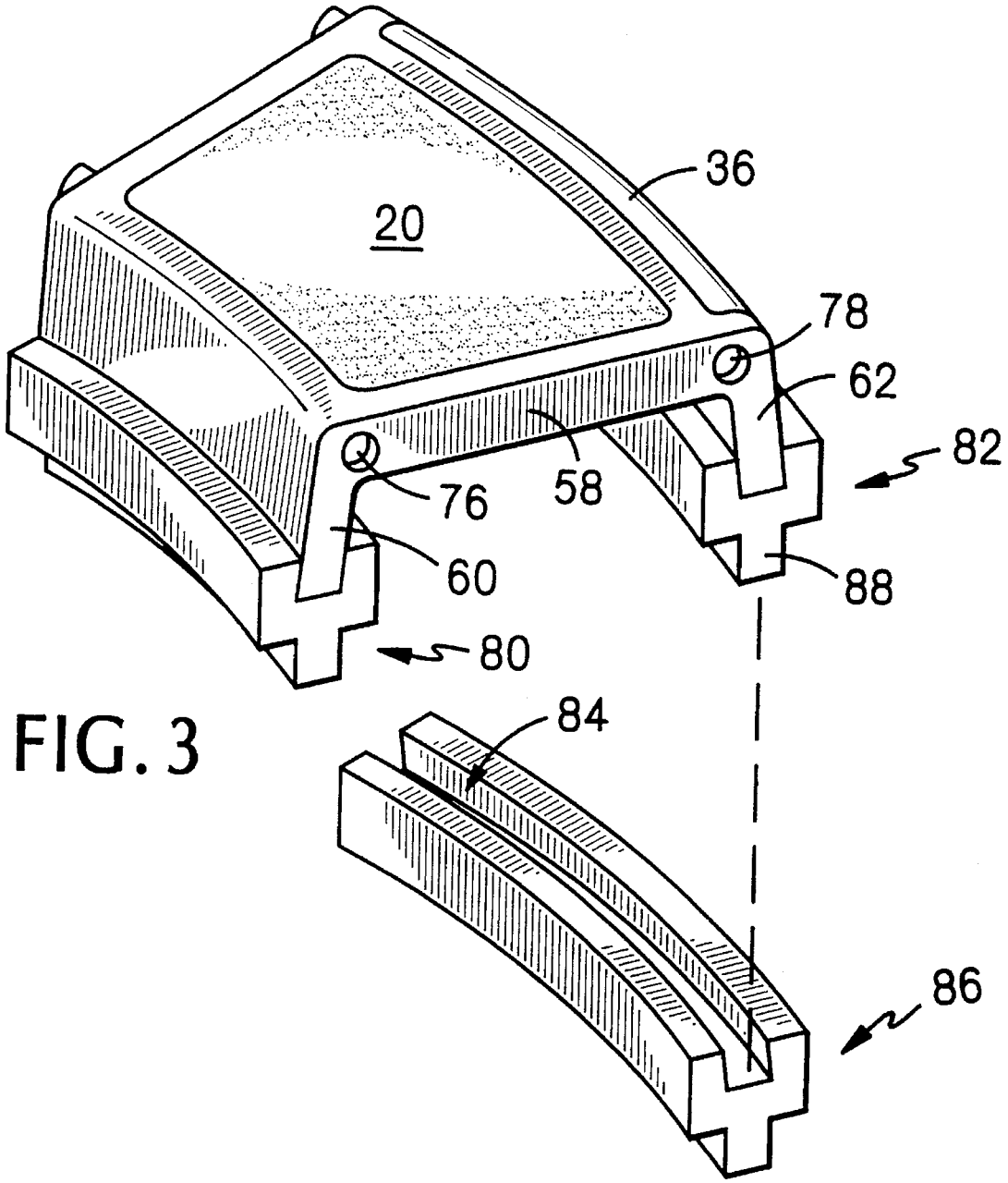
FIG. 3 is a diagrammatic perspective view of step support structure of the invention coupled to a pair of risers.

Referring to FIG. 3, the height of each step surface may be increased selectively by fitting one or more risers 80, 82 to the bottom edges of the side walls of a step platform. Each riser defines a groove 84 sized to receive the bottom edges of the side walls of the step platform. The height of each step surface may be further increased by coupling the receiving groove of an additional riser 86 to a mating bottom edge 88 of a previously mounted riser 82. In an alternative embodiment, the rises are formed from a single support that fits under both side walls of a step platform at the same time.

In a presently preferred embodiment, the step platforms are connectable edge-to-edge in an arcuate pattern, as shown in FIG. 1. Each platform has a predetermined dimensions of length, e.g. 13½ inches on the inside radial dimension and 22 inches on the outside radial dimension, and width, e.g. 14 inches, and the entire stepping platform assembly is about 6½ feet wide from end-to-end. The base height of each stepping surface is about 4 inches; each riser adds about 2 inches to the base height of the stepping surface. The step elements of the exercising system are constructed to be nested together for a smaller storage volume. In one embodiment, the controller is mounted on a wheeled support post structure that is attached to the central step element, and the other step elements stack up on the central step element; the entire step exercising system can then be conveniently rolled to a storage area.

Figure 4:
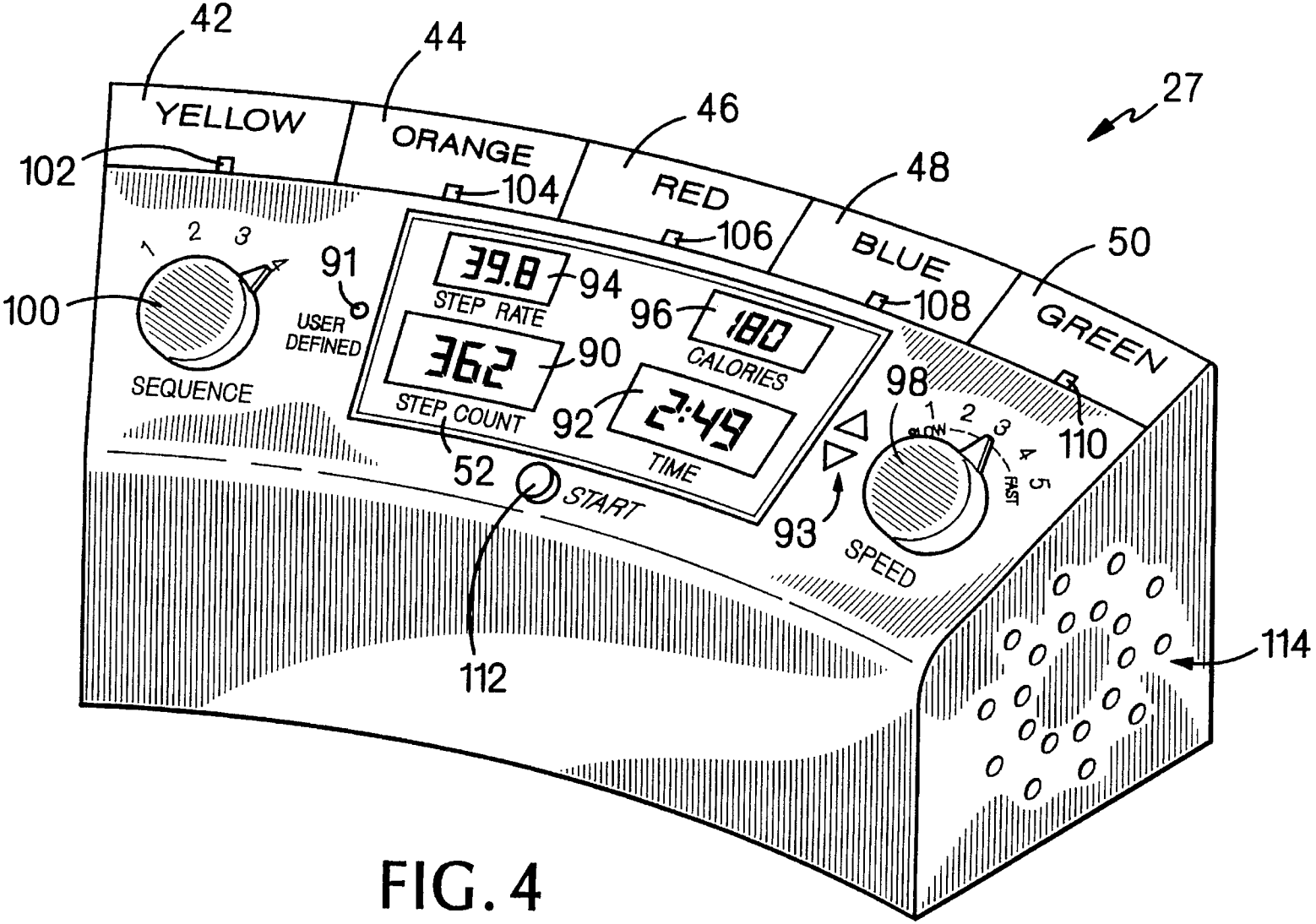
FIG. 4 is a diagrammatic perspective view of a control console of the step exercising system of FIG. 1.

Referring to FIG. 4, as indicated above, console 27 includes a monitor 52 for displaying parameters indicative of the user's workout performance. A step count window 90 displays the total number of steps during a workout. Step count window 90 also displays the total number of missteps made by a user during a workout when a toggle switch 91 is activated. A timer window 92 displays the workout time remaining (in an alternative embodiment, the timer window displays the running workout time). Timer control buttons 93 allow selection of the workout time. Step rate window 94 and calorie window 96 respectively display the average steps per minute and estimated number of calories burned during a workout. A workout speed knob 98 selects the pace of the workout (i.e., the rate at which the controller cues the steps during a workout). A sequence knob 100 selects the workout sequence to be choreographed by the controller. In a presently preferred embodiment, sequence knob positions 1–3 correspond to preselected workout sequences and knob position 4 corresponds to a step sequence that varies randomly during the workout. When the sequence knob is in the "USER-DEFINED" position, the controller follows a step sequence defined by the user, which may be selected by depressing buttons 102–110, associated with console lights 42–50, in an ordered sequence and by storing the selected sequence in controller memory, or by downloading a software-based pre-defined sequence from an external source (e.g., a computer diskette) into controller memory. A workout is initiated by depressing a start button 112. The console also includes a speaker 114 selectively activated by the controller to provide real-time feedback to the user indicative of the user's workout performance. During a workout, the speaker emits a relatively short tone if the user stepped onto a cued step within a preselected period of time. On the other hand, if the user does not step onto the cued step in time, or steps onto a step other than the cued step, the speaker emits a relatively long tone. In an alternative embodiment, the pitch of the tone emitted for successful steps is higher than the tone emitted for missteps.

Figure 5:
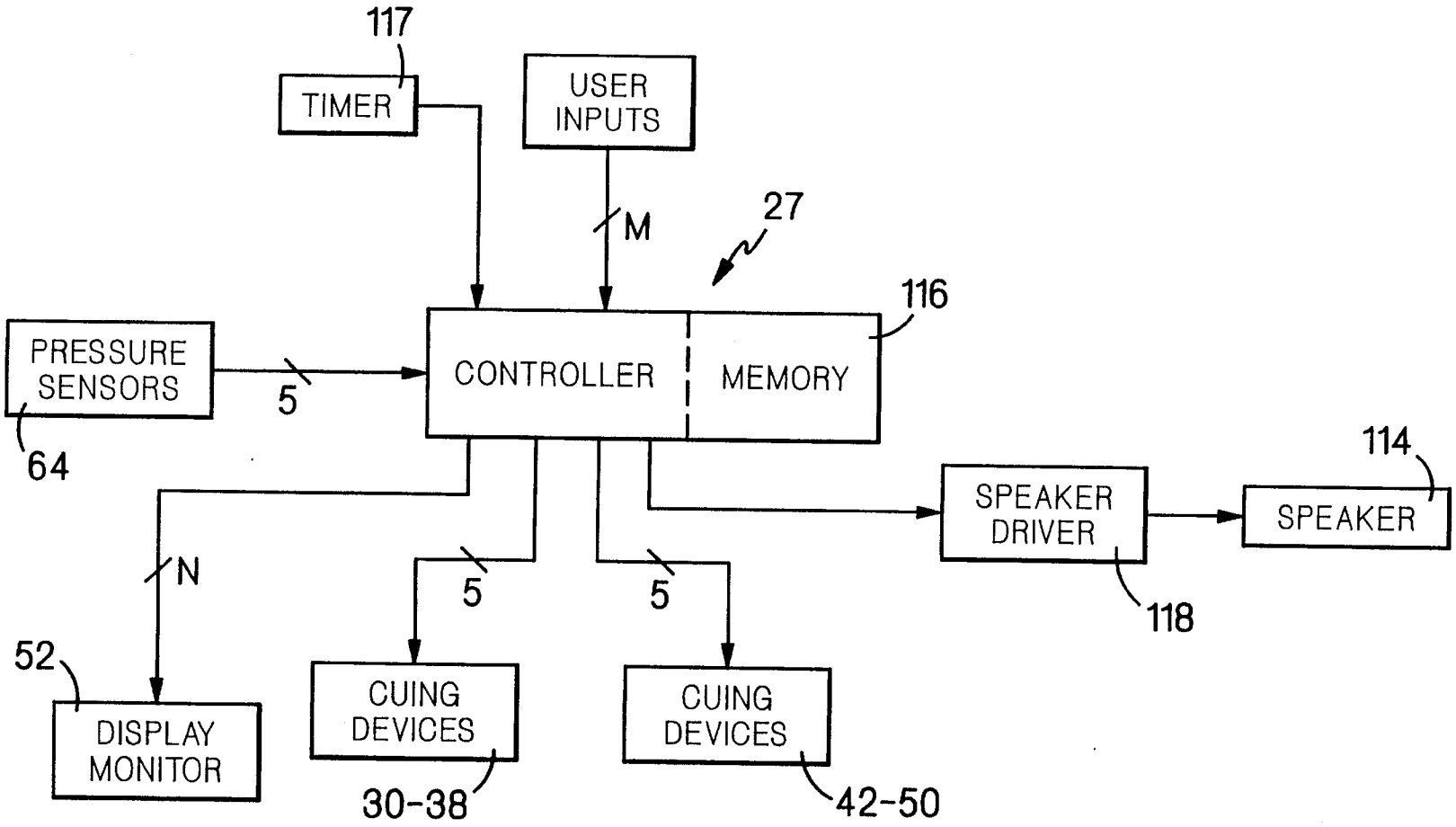
FIG. 5 is a block diagram of electrical connections between a controller, several inputs into the controller, and several outputs from the controller in the step exercising system of FIG. 1.

Referring to FIGS. 5 and 5A, before a workout is initiated, controller 27 receives M user inputs (e.g., workout time, sequence selection, workout speed, start, etc.). The controller has a memory 116 for storing a plurality of pre-defined or user-defined step sequences. During the workout, the controller activates the cuing devices 30–38 (and corresponding cuing devices 42–50) in an ordered sequence, corresponding to the sequence selected by the user, and receives input from pressure sensors 64, indicating which step surfaces have been stepped upon by the user. The controller also receives the workout time from a timer 117. Controller 27 selectively activates a speaker driver 118 to cause speaker 114 to emit a tone of appropriate duration and pitch in response to feedback received from the pressure sensors. The results of various real-time parameters indicative of the user's workout performance (e.g., workout time remaining, step count, number of missteps, average step rate, and average number of calories burned determined from, e.g., step rate and workout time) are sent by controller 27 to monitor 52 for display.

Figure 6:
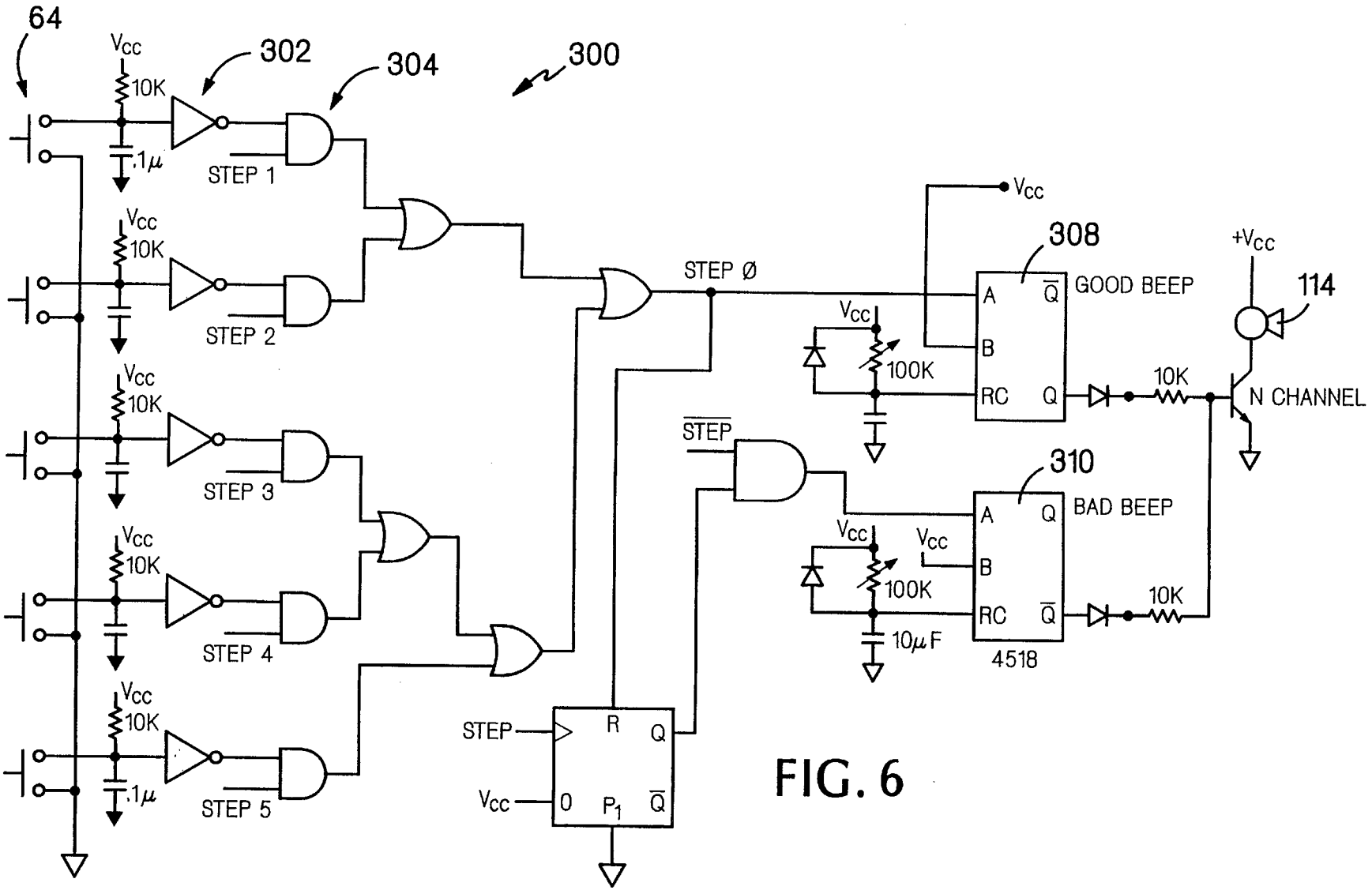
FIG. 6 is a schematic circuit diagram of a hardware-implemented controller of a step exercising system of the invention.
Figure 6A:
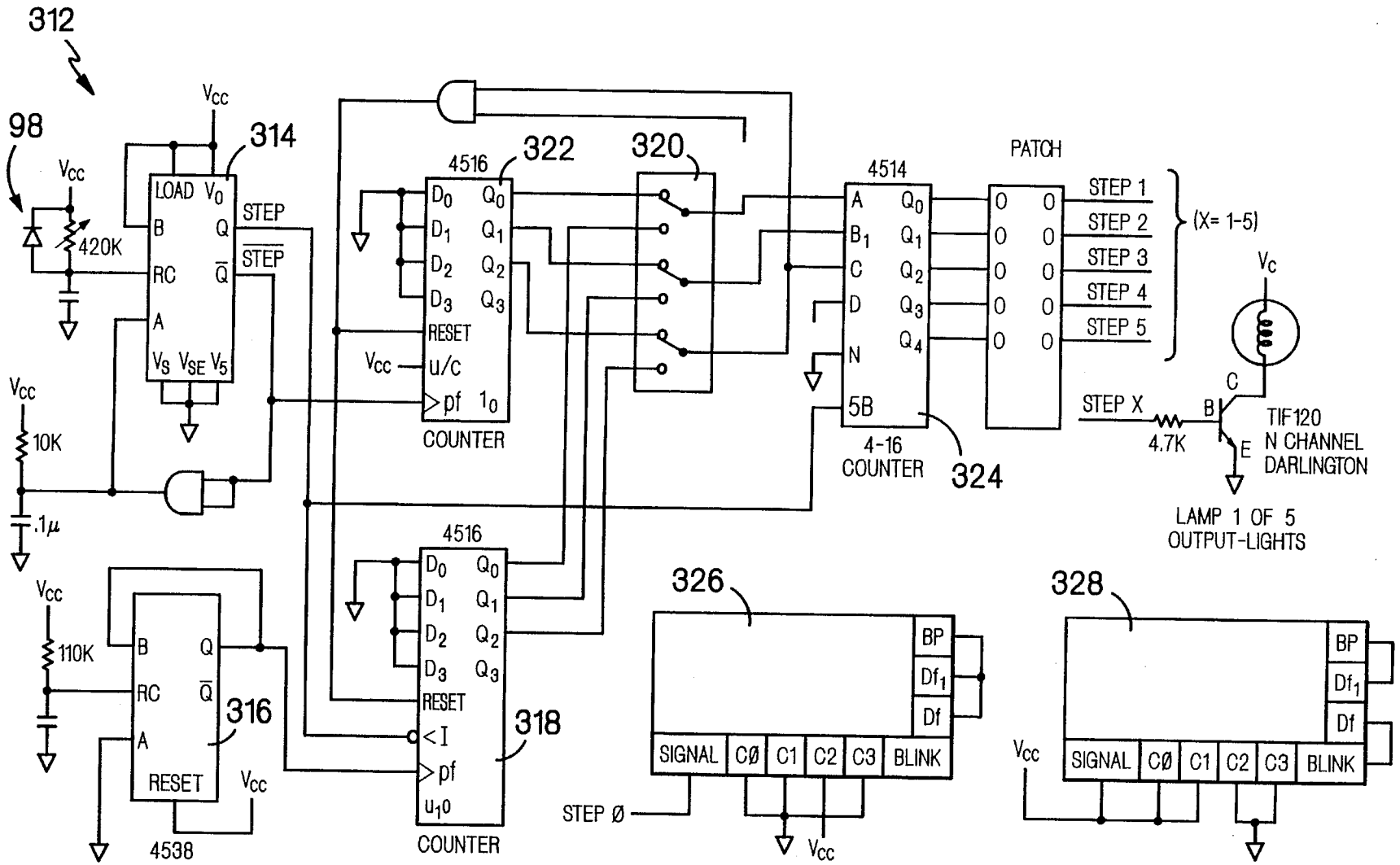

Referring to FIG. 6, in one embodiment, controller 27 is implemented in hardware. A first control circuit 300 determines if the user has correctly stepped on a cued step within a preselected period of time (determined by the workout pace selected by the user). Pressure sensors 64 are connected in parallel to circuit 300 through input buffers 302, which are respectively coupled to one input of respective AND gates 304. The other input of each of the AND gates is coupled to the controller, which provides signals indicative of the step that has been cued to the user. Mono-stable pulse generators 308,310 are used to determine whether or not the user stepped on the correct step within the selected period of time and cause speaker 114 to emit a short or a long tone, respectively. A second control circuit 312 generates a sequential or a random step sequence for choreographing a step workout, depending on the sequence selected by the user. Mono-stable pulse generators 314, 316 are coupled to the speed selector 98 to allow the user to select the workout pace. The pulse generators output step signals to a counter 318 that is coupled to a mode switch 320. When the switches are in a first position (as shown) a sequential step sequence is produced by counter 322; when the switches are in the other position a random sequence is generated by counter 318. The mode switch couples the step sequence signals from the counters to a decoder 324 which provides output signals to the cuing lights. A step counter monitor 326 displays the number of correct steps and a minute counter monitor 328 displays the total workout time. In an alternative embodiment, the controller is implemented as a software program that is run on a microprocessor.

Figure 7:
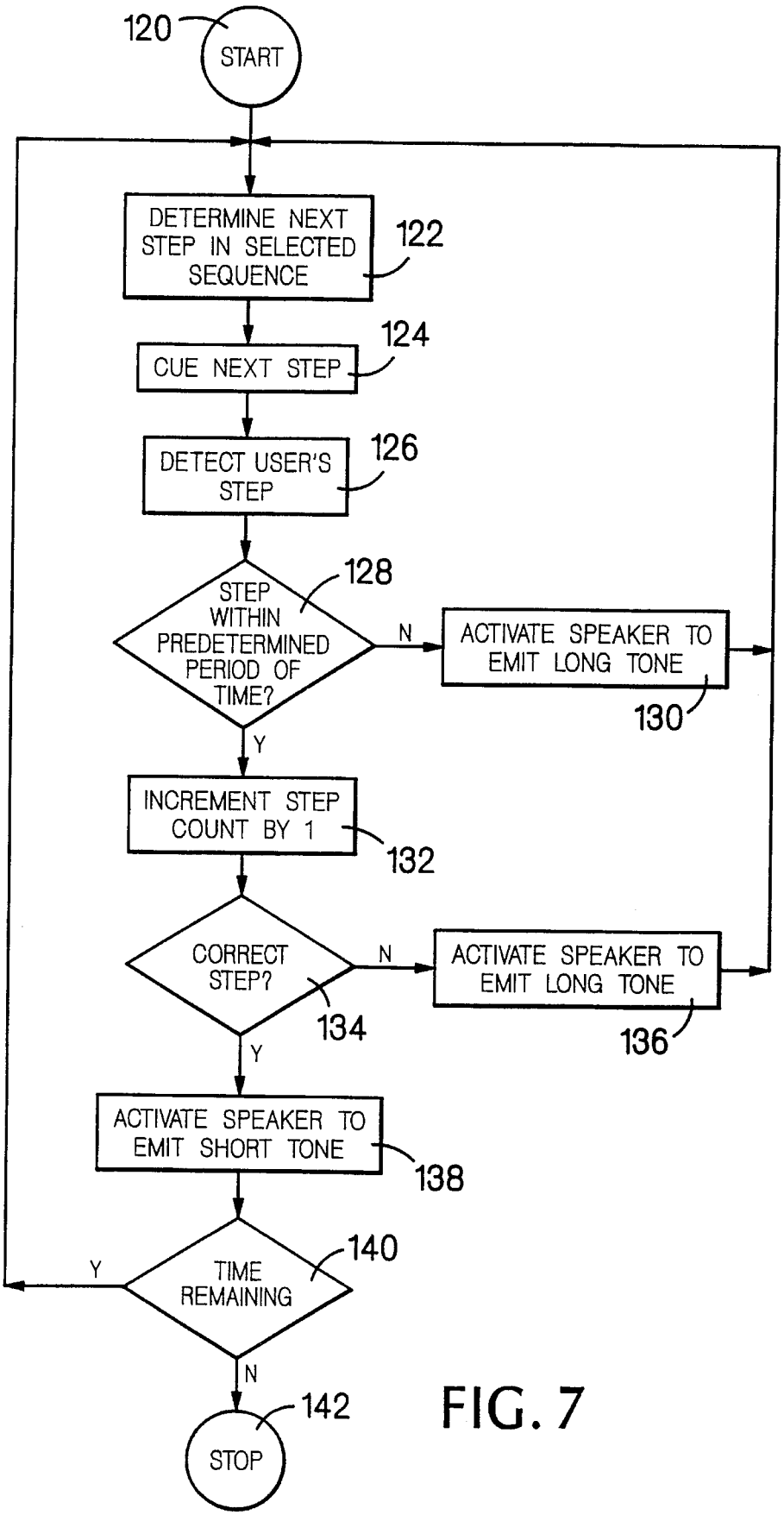
FIG. 7 is a flow diagram of an aerobic step workout to be choreographed by a controller of the invention.
Figure 7A:
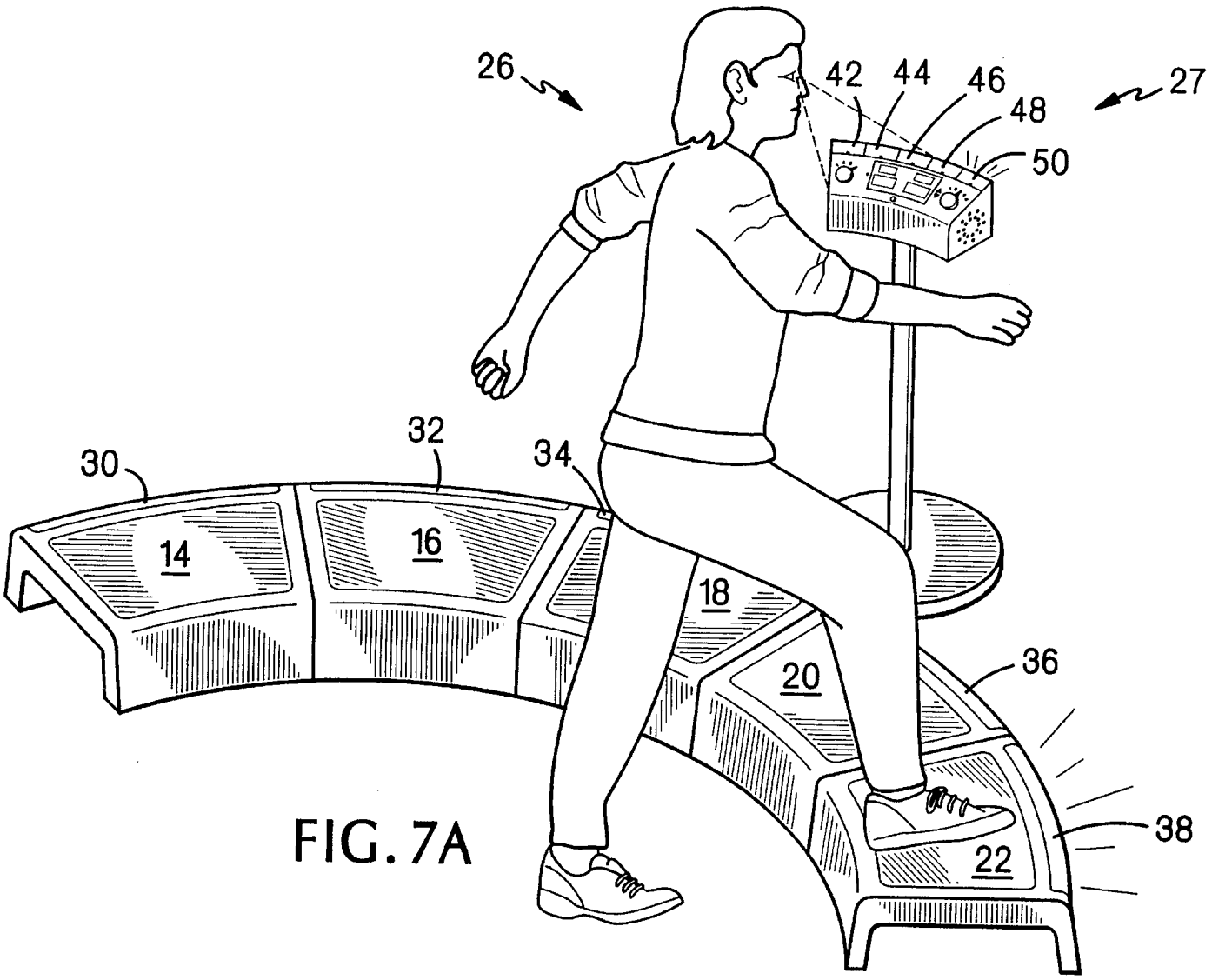
FIG. 7A is a somewhat diagrammatic view of a user stepping onto a step surface of the invention during the aerobic step workout of FIG. 7.

Referring to FIGS. 7 and 7A, in one embodiment, controller 27 choreographs an aerobic step workout for a user 26 by the sequence of steps now to be described.

After the user presses the start button (120), the controller determines the next step in the step sequence selected by the user (122). The controller cues the next step to the user by simultaneously activating, e.g., cuing devices 38 and 50, corresponding to the green step (124). This signals to user 26 to step onto green step surface 22 (FIG. 7A). The controller receives feedback from the pressure sensors to determine which surface was stepped upon and to determine the length of time between when the step was cued and when the pressure sensor was activated (126). The controller determines if the user stepped upon the step surface within a predetermined period of time, which depends on the workout speed selected by the user (128). If the user stepped upon the step surface after the predetermined period of time, the controller activates the speaker driver to cause the speaker to emit a long (or low) tone (130) and the process is repeated for the next step in the sequence (122); otherwise, the controller increments the step count by one (132). The controller then determines whether the user stepped upon the correct step (134). If the user stepped onto an incorrect step, the controller activates the speaker driver to cause the speaker to emit a long (or low) tone (136) and the process is repeated for the next step in the sequence (122); otherwise, the controller activates the speaker driver to cause the speaker to emit a short (or high) tone (138). If there is workout time remaining (140), the process is continued for the next step in the sequence (122); otherwise, the controller stops the workout (142).

Exemplary sequences of aerobic workout sequences contemplated will now be described. These step sequences are labelled to correspond to the colors of the step surfaces shown in FIG. 1.

EXAMPLE 1

In a first exemplary sequence, the controller cues the following step sequence to a user during an aerobic step workout.

| Step Number | Color of Cued Step Surface |
|---|---|
| 1 | YELLOW |
| 2 | ORANGE |
| 3 | RED |
| 4 | BLUE |
| 5 | GREEN |
| 6 | GO TO STEP 1 & REPEAT SEQUENCE |

EXAMPLE 2

In a second exemplary sequence, the controller cues the following step sequence to a user during a step workout.

| Step Number | Color of Cued Step Surface |
|---|---|
| 1 | YELLOW |
| 2 | GREEN |
| 3 | ORANGE |
| 4 | BLUE |
| 5 | RED |
| 6 | GO TO STEP 1 & REPEAT SEQUENCE |

EXAMPLE 3

In a third exemplary sequence, the controller cues the following step sequence to a user during a step workout.

| Step Number | Color of Cued Step Surface |
|---|---|
| 1 | YELLOW |
| 2 | RED |
| 3 | ORANGE |
| 4 | BLUE |
| 5 | RED |
| 6 | GREEN |
| 7 | GREEN |
| 8 | RED |
| 9 | BLUE |
| 10 | ORANGE |
| 11 | RED |
| 12 | GO TO STEP 1 & REPEAT SEQUENCE |

EXAMPLE 4

In a fourth exemplary sequence, the controller cues a random step sequence to a user during an aerobic step workout. For this step sequence, the controller uses an internal random number generator to determine the step sequence to cue.

EXAMPLE 5

Figure 8:
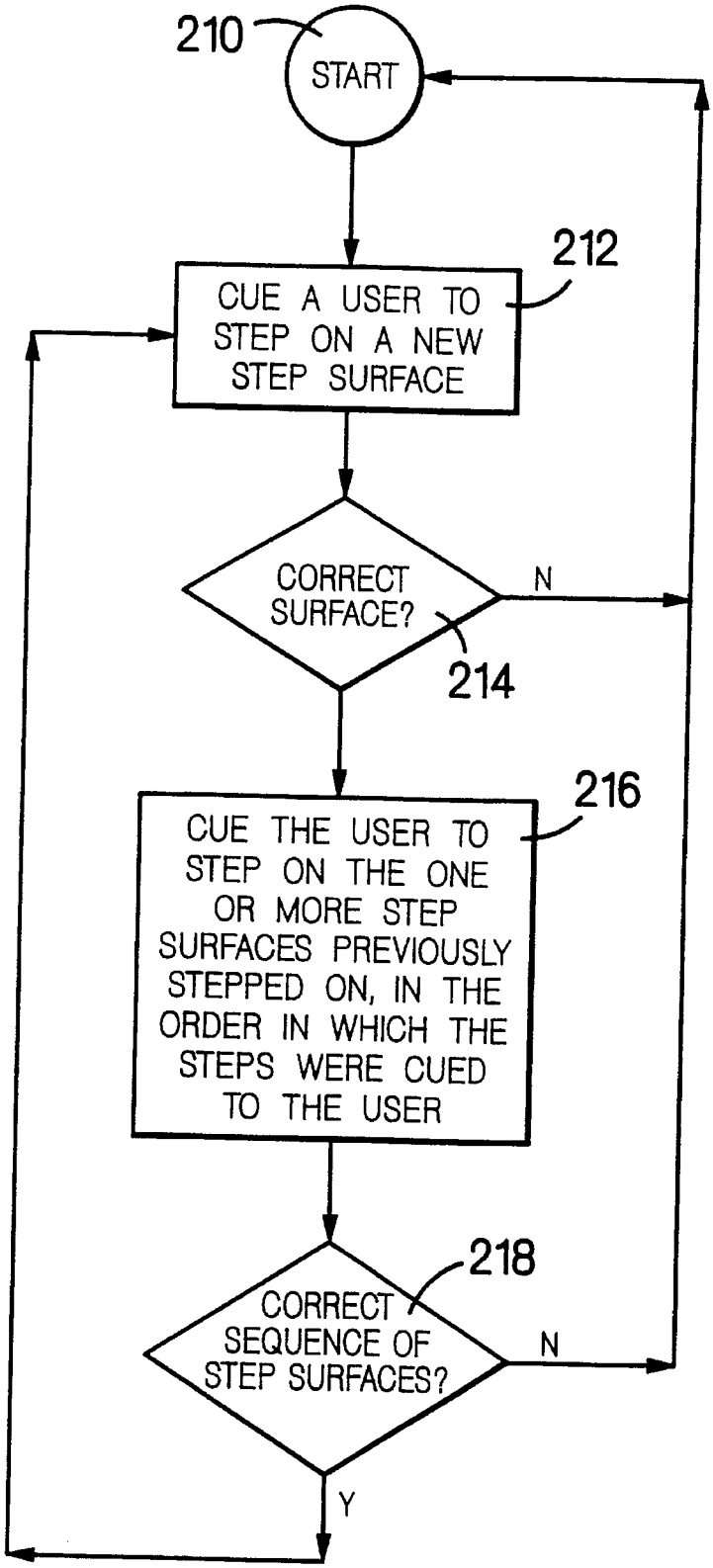
FIG. 8 is a flow diagram of an exemplary step sequence of the invention.

Referring to FIG. 8, in a fifth exemplary sequence, the controller cues the user by the following sequence of steps. At the start (210), the controller has a predetermined sequence in memory, e.g., one of the above-described exemplary sequences. The controller cues a user to step onto a new step surface in the sequence (212). The controller determines if the user stepped onto the correct step surface (214). If the user stepped onto an incorrect surface, the controller repeats the sequence from the start (210). If the user stepped onto the correct surface, the controller sequentially cues the user to step onto one or more of the step surfaces previously stepped upon since the start of the sequence, in the order in which the steps were cued to the user (216). The controller then determines if the sequence followed by the user corresponds to the cued step sequence (218). If the user followed an incorrect sequence, the controller repeats the sequence from the start (210); otherwise, the controller continues choreographing the workout by cuing a new step surface in the sequence (212) and repeating the subsequent cuing and determining steps.

Other embodiments are within the scope of the claims. For example, the stepping platforms may be arranged in a straight line from end-to-end rather than in an arcuate pattern. Alternatively, the stepping platforms may be arranged in a zig-zag (wavy) pattern.

Figure 9:
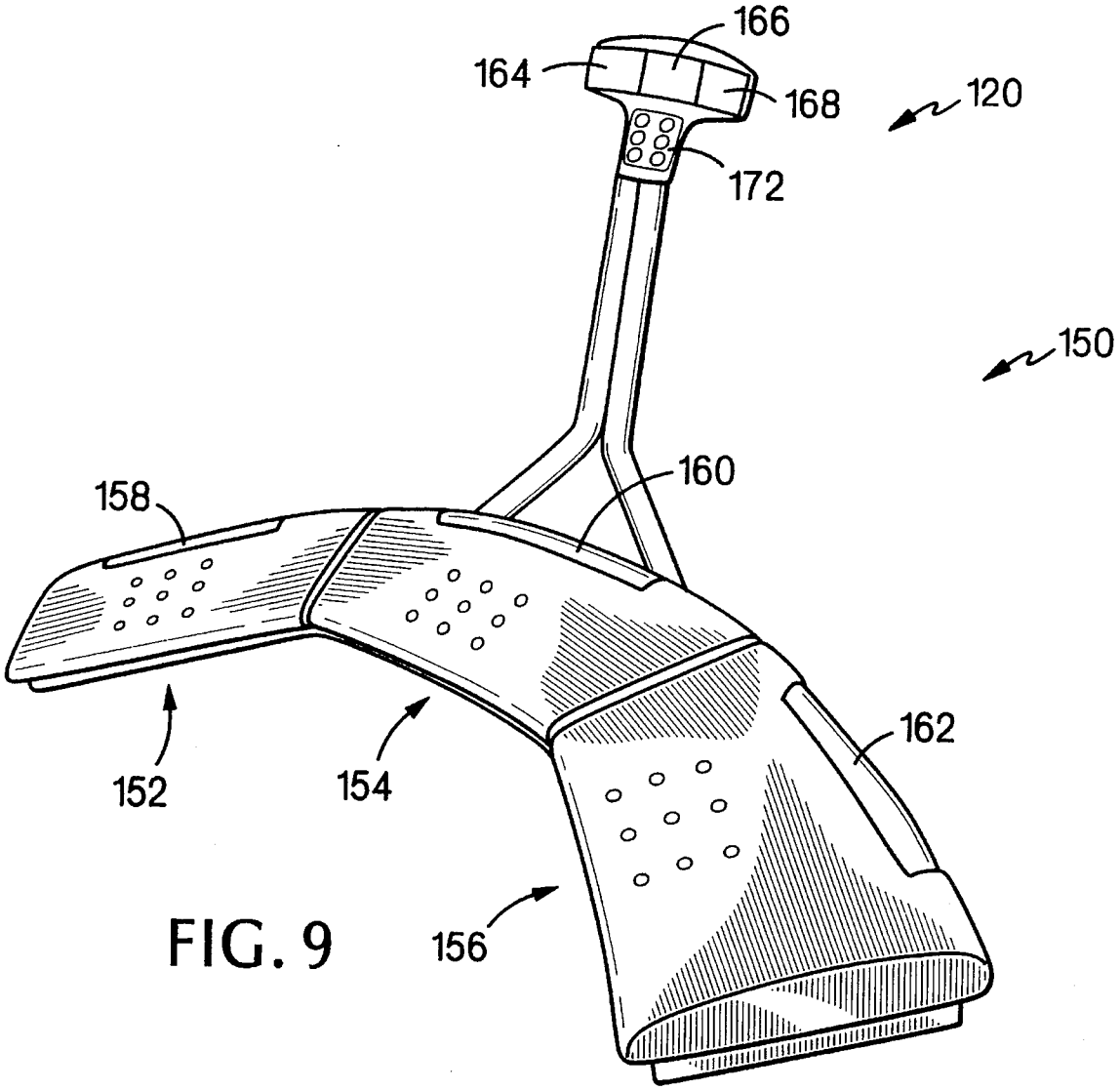
FIG. 9 is a diagrammatic perspective view of an alternative step exercising system of the invention.

Also, a step exercising system of the invention may include two or more step surfaces depending on the user's preference. For example, referring to FIG. 9, a step exercising system 150 includes three step surfaces 152–156, which have corresponding cuing devices 158–162 mounted upon the step platform and corresponding cuing devices 164–168 mounted a console 170. Console 170 also includes a user interface 172 that has an input for receiving user commands.

Figure 10:
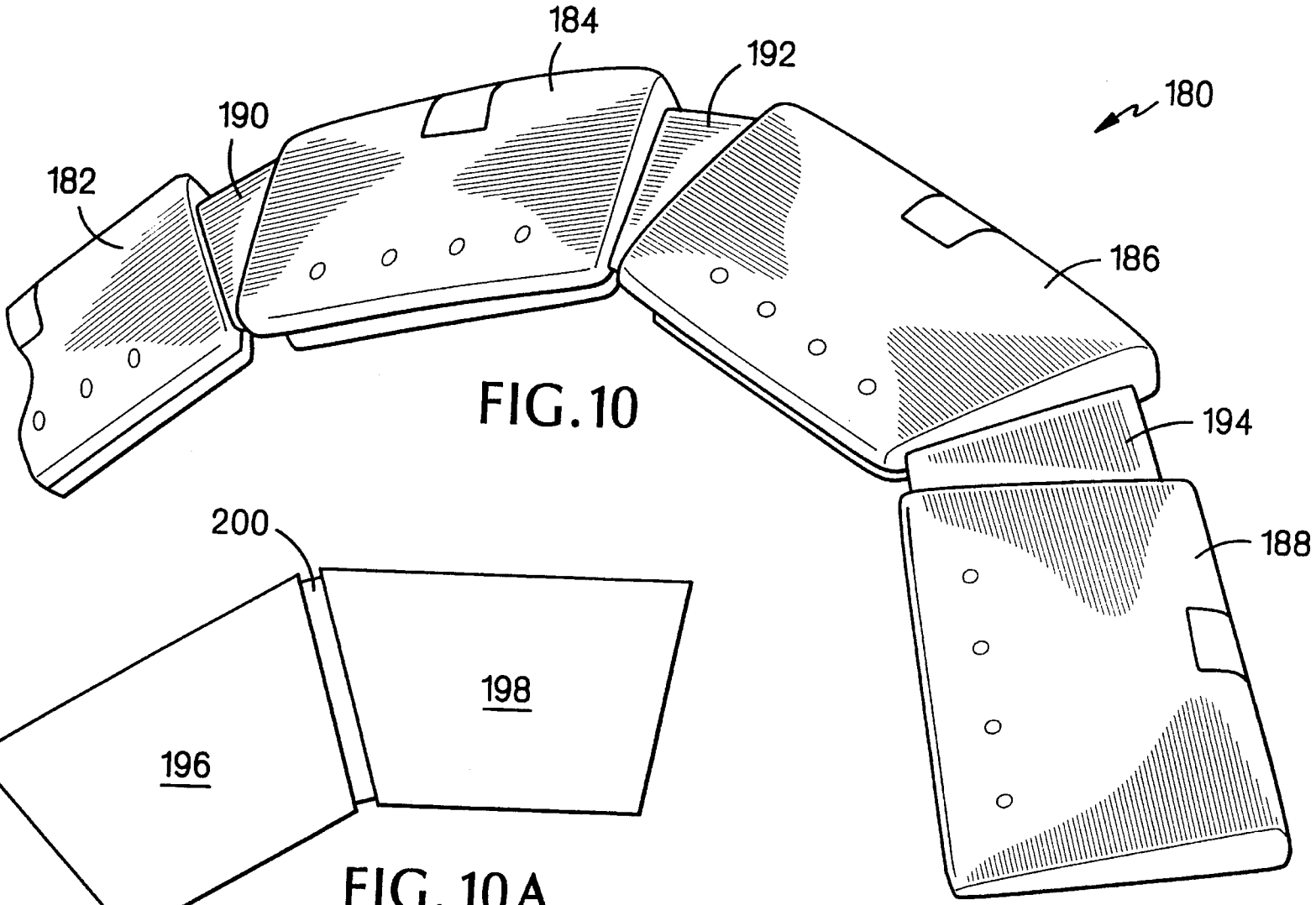
FIGS. 10 and 10A are diagrammatic views of alternative embodiments of step-connecting structures of the invention.

Referring to FIG. 10, an alternative step exercising system 180 includes step support structures 182–188 that are slidably coupled together by rigid coupling members 190–194. The coupling members slide into adjacent step support structure, enabling the step surfaces to be selectively spread apart either in a straight line or in an arcuate pattern (as shown).

Figure 10A:
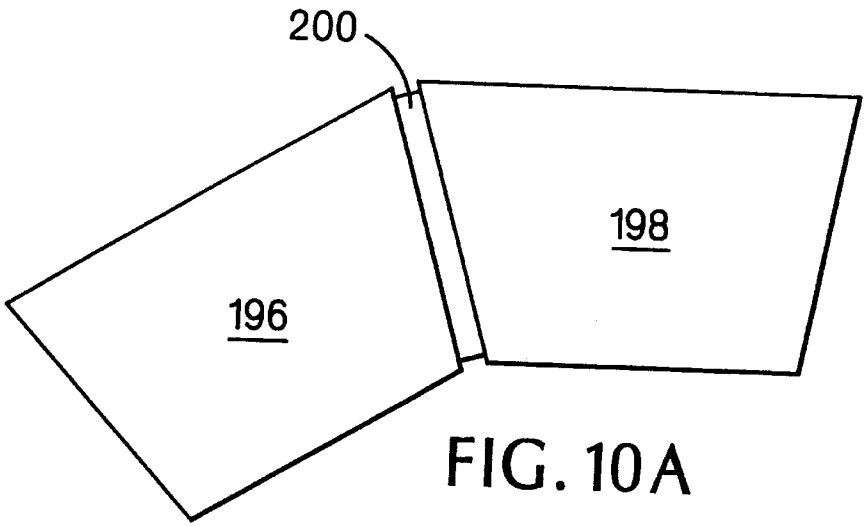

Referring to FIG. 10A, in still another embodiment, adjacent step structures 196, 198 are coupled together by a strip connector 200.

In another embodiment, two or more independent exercising systems may be coupled to a single controller so that a game may be played in which two or more people are able to compete against each other, e.g., to see who achieves the most correct steps for a given step sequence and a given speed setting.

Other schemes for signalling step instructions to a user are contemplated. In yet another embodiment, the cuing device includes a voice processor for cuing voiced stepping instructions. In this embodiment, step instructions used in traditional step classes may be provided by the voice processor. For example, the voice processor may issue known step combinations, such as, "step touch", "basic step", "over the top", and "straddle". Alternatively, the monitor may be configured to display text instructions to the user. Or, instead of using color coding, the step platforms may by numbered and the monitor may be configured to cue the user by displaying a number sequence to the user, corresponding to a selected workout step sequence.

In a further embodiment, a sound system (e.g., a cassette player or a CD player) is mounted with the controller for playing music selected by the user during a choreographed step workout. The workout may be synchronized with the music.

Still other embodiments are within the scope of the claims.

What is claimed is:

1. A step exercising system for choreographing an aerobic step workout comprising:

a plurality of spaced-apart step surfaces supported above a ground surface by respective step heights that are selected to enable a user to step from the ground surface onto the step surfaces during a step workout, the spaced-apart step surfaces being movable with respect to each other to enable selective variation of the distances separating the step surfaces;

a cuing device for indicating to the user which step surfaces to step on; and a controller coupled to the cuing device and constructed and arranged to activate the cuing device to indicate to the user an ordered sequence of step surfaces to step on, thereby choreographing an aerobic step workout for the user.

2. The step exercising system of claim 1 wherein the cuing device comprises a plurality of separate cuing devices respectively associated with the spaced-apart step surfaces.

3. The step exercising system of claim 1 further comprising a plurality of sensors respectively positioned at the step surfaces for detecting when the user steps onto the step surfaces.

4. The step exercising system of claim 3 wherein the sensors are pressure sensors.

5. The step exercising system of claim 3 wherein the sensors are coupled to the controller, the controller being further adapted to communicate to a user that the user successfully stepped upon a cued step surface.

6. The step exercising system of claim 3 wherein the sensors are coupled to the controller, the controller being further adapted to communicate to a user that the step sequence followed by the user did not correspond to the step sequence cued by the controller.

7. The step exercising system of claim 1 further comprising a monitor, wherein the controller is further adapted to determine a running total of the user's missteps and to display the determined number of missteps on the monitor.

8. The step exercising system of claim 1 further comprising a monitor, wherein the controller is further adapted to determine the user's average step rate and to display the determined average step rate on the monitor.

9. The step exercising system of claim 1 further comprising a monitor, wherein the controller is further adapted to determine an estimated number of calories burned by the user during a workout and to display the estimated number of calories on the monitor.

10. The step exercising system of claim 1 wherein the movable step surfaces are electrically coupled to the controller by coiled wire running between the step surfaces, wherein the spacing between coils in the coiled wire between two step surfaces spread apart when the surfaces are moved apart.

11. The step exercising system of claim 1 wherein the step surfaces are arranged in an arcuate pattern.

12. The step exercising system of claim 2 wherein the cuing devices emit light to cue the user.

13. The step exercising system of claim 12 wherein each cuing device associated with a step surface emits light of a different color from that emitted by any other cuing device.

14. The step exercising system of claim 1 wherein the controller has memory for storing a plurality of preselected step sequences.

15. The step exercising system of claim 14 further comprising a user interface having an input for receiving commands from the user specifying one or more of the preselected step sequences.

16. The step exercising system of claim 1 wherein the controller is adapted to choreograph a random step sequence.

17. The step exercising system of claim 1 further comprising a user interface having an input for receiving commands from the user for selecting an intensity level for the workout to be choreographed by the controller.

18. The step exercising system of claim 1 further comprising one or more risers adapted to couple to the step surfaces to selectively increase the height of one or more of the step surfaces above the ground surface.

19. The step exercising system of claim 1 wherein the step surfaces number from three to five.

20. The step exercising system of claim 1 further comprising including a second set of spaced-apart step surfaces supported above a ground surface by respective step heights that are selected to enable a second user to step from the ground surface onto the step surfaces during a step workout, and a second cuing device associated with the second set of spaced-apart step surfaces for indicating to the second user which step surfaces to step on, the second cuing device being coupled to the controller which is adapted to choreograph separate aerobic step workouts for first and second users on the first and second sets of step surfaces respectively.

21. A method for choreographing an aerobic step workout comprising the steps of:

(a) providing a plurality of spaced-apart step surfaces supported above a ground surface by respective step heights that are selected to enable a user to step from the ground surface onto the step surfaces during a step workout, the spaced-apart step surfaces being movable with respect to each other to enable selective variation of the distances separating the step surfaces;

(b) cuing the user with a plurality of cuing derides respectively associated with the spaced-apart step surfaces to indicate which step surfaces to step on; and (c) choreographing an aerobic step workout for the user by cuing with the cuing devices an ordered sequence of step surfaces for the user to step on.

22. The method of claim 21 wherein the cuing devices include respective light sources that emit light of different colors and the cuing step comprises activating a light source associated with the step surface to be stepped on.

23. A method for choreographing a user's aerobic step workout comprising the steps of:

(a) providing a plurality of spaced-apart step surfaces supported above a ground surface by respective step heights that are selected to enable a user to step from the ground surface onto the step surfaces during a step workout, the spaced-apart step surfaces being movable with respect to each other to enable selective variation of the distances separating the step surfaces;

(b) cuing the user to step onto one of the step surfaces;

(c) cuing the user to sequentially step onto the one or more steps previously stepped on, in the order in which the steps were cued to the user;

(d) determining if the step sequence followed by the user corresponds to the cued step sequence; and (e) repeating-steps (b), (c), and (d) until a preselected workout is complete or until the step sequence followed by the user does not correspond to the cued step sequence.

* * * * *

UNITED STATES PATENT AND TRADEMARK OFFICE

CERTIFICATE OF CORRECTION

PATENT NO. : 5,584,779

DATED : December 17, 1996

INVENTOR(S) : Wendy S. Knecht and Kenneth A. Tarlow

It is certified that error appears in the above-identified patent and that said Letters Patent is hereby corrected as shown below:

Col. 10, line 13, "comprising including" should be --comprising--.

Col. 10, line 22, --,-- missing after word "surfaces".

Col. 10, line 34, "derides" should be --devices--.

Signed and Sealed this

Twenty-seventh Day of October, 1998

*Attest:*

Bruce Lehman

BRUCE LEHMAN

*Attesting Officer*

*Commissioner of Patents and Trademarks*